United States Patent [19]

Goguelin

[11] Patent Number: 5,008,306

[45] Date of Patent: Apr. 16, 1991

[54] REINFORCED THERMOPLASTICS SHEET AND ITS MANUFACTURING PROCESS

[75] Inventor: Michel Goguelin, Charavines, France

[73] Assignee: Exxon Chemical Patents Inc., Florham Park, N.J.

[21] Appl. No.: 223,022

[22] Filed: Jul. 22, 1988

[30] Foreign Application Priority Data

Jul. 23, 1987 [FR] France ..... 87 10490

[51] Int. Cl.[5] ..... C08K 7/00

[52] U.S. Cl. ..... 523/220; 523/333; 523/334; 524/35; 524/322; 524/494

[58] Field of Search ..... 523/333, 334, 220; 524/35, 322, 494

[56] References Cited

U.S. PATENT DOCUMENTS

| | | | |
|---|---|---|---|
| 3,201,304 | 8/1965 | Munjat | 524/35 |
| 3,684,545 | 9/1972 | Worral | 117/3.4 |
| 3,716,449 | 2/1973 | Gatward | 162/101 |
| 4,194,999 | 3/1980 | Hayashi et al. | 524/35 |
| 4,426,470 | 1/1984 | Wessling | 524/35 |

FOREIGN PATENT DOCUMENTS

| | | |
|---|---|---|
| 0039292 | 11/1981 | European Pat. Off. . |
| 0180863 | 5/1986 | European Pat. Off. . |
| 2179204 | 11/1973 | France . |
| 1263812 | 2/1972 | United Kingdom . |

*Primary Examiner*—Paul R. Michl
*Assistant Examiner*—Karen A. Hellender
*Attorney, Agent, or Firm*—Bacon & Thomas

[57] ABSTRACT

Fiber reinforced thermoplastics sheet is produced by a wet method from (a) an aqueous dispersion of reinforcing fibers an dispersing agent; and (b) an aqueous dispersion of thermoplastics polymer powder and an ionic polymer additive of opposite charge to the fiber dispersion. The dispersions are mixed, a high molecular weight ionic polymer flocculating agent is added, of charge opposite to that of the mixture, and the resulting suspension is drained and dried to form the sheet.

26 Claims, No Drawings

REINFORCED THERMOPLASTICS SHEET AND ITS MANUFACTURING PROCESS

The present invention relates to a thermoplastic semi-finished product containing reinforcing fibers, and to its manufacturing process by homogeneous mixing in aqueous medium.

BACKGROUND OF THE INVENTION

Semi-finished products in supple or rigid sheet form are already known, in which the sheets are constituted of reinforcing fibers, generally glassfibers, with a thermoplastics resin selected from polyamides, polyesters, etc. . . . but beinjg smainly a polyolein. The sheets are designed to be transformed under heat by molding-stamping or thermoshaping.

It is known that, in a thermoplastics resin, the fibers only produce their maximum reinforcing effect if:

on the one hand, they have at least a critical length of about 5 mm for glassfibers, below which the material will break under strain without the fibers breaking, and if, on the other hand, they are completely wetted by the thermoplastics resin, a quality which cannot be obtained when the fibers are not unitary, but assembled in rove or glass strand form, since then the thermoplastics resins, in molten state, are too viscous to really impregnate them thoroughly.

It is also known that the longer the reinforcing fibers are, the poorer is the moldability of the thermoplastics semi-finished product, and that, in practice, if the length exceeds a few centimeters, the distribution of the reinforcement, although it may be homogenous within the sheet, is no longer uniform throughout the whole molded piece.

One means of individualising the reinforcing fibers, without breaking them, inside a thermoplastics resin, consists in dispersing them in aqueous phase, for example in roves or glass strands form, and in mixing them with the powdered resin. This means, which uses the wet method, comes under the general principle of papermaking and therefore will require, in order to obtain the ideal sheet, that a number of technical conditions be met:

1. A retention of the elements of the composition, in particular the powders, namely the resin and the additives (for example antioxidants, dyes, antistatic agents, and age-protecting agents).

2. A good dispersion of the reinforcing fibers with the powder, which fibers should be distributed homogeneously through the thickness of the sheets.

3. The formation of a sheet with sufficient cohesion to allow its drying and its manipulation during transformation.

Various solutions have been proposed, consisting:

either in draining the mixture of cut fibers and powder through a glass strand mat which is used as a self-supporting base, as described in U.S. Pat. No. 3,684,545 or in adding to the mixture of cut fibers and powder, a latex binder and natural or synthetic fibers with high specific surface area, as described in GB-A-1 263 812, in EP-A-0 039 292 and in U.S. Pat. No. 4,426,470.

Each case, therefore, implies bringing raw materials into the sheet, the nature and quality of which materials is undesirable for the properties of the finished plastics piece.

In some cases, a good dispersion of the reinforcing fibers is achieved by working with very high dilutions and/or by increasing the viscosity of the water as described in EP-A-0 180 863, or else by producing a foamy dispersion as described in GB-A-1 263 812, all these means implying material modifications over the conventional papermaking machines, which are often important, such as those described in FR-A-2 179 204 and U.S. Pat. No. 3,716,449.

There is therefore a desideratum to minimise the aforesaid disadvantages by providing a reinforced thermoplastics sheet which, being prepared by the wet method, from a mixture of cut fibers and powder, without any addition of latex binder being required, contains substantially only those elements which are suitable and necessary for the final plastic application.

According to the present invention there is provided a process for preparing by the wet method a reinforced thermoplastics semi-finished product in sheet form, wherein said process comprises the following steps:

(a) providing a first aqueous dispersion of a dispersing agent with reinforcing fibers, (b) providing a second aqueous dispersion containing at least one thermoplastics polymer powder and at least one ionic polymer additive of opposite charge to that of the first dispersion, (c) mixing the two dispersions to form a mixture, (d) incorporating into the mixture a flocculating agent in ionic polymer form, of high molecular weight and of charge opposite to that of said mixture, and (e) draining the resulting suspension and drying the resulting semi-finished product.

Step (e) is preferably carried out by draining the suspension on a metallic form or wire; after drying the semi-finished product is preferably heat-strengthened.

The reinforcing fibers used in the process according to the invention are fibers of which the physical structure remains of course unchanged after molding of the semi-finished product. They are, whether used on their own or in a mixture, cylindrical synthetic fibers such as carbon fibers, organic fibers with a high melting point (aramides, polyester and others), glass wool, rock wool, but the preferred reinforcement according to the invention is constituted by glassfibers. Preferably the fibers are of length from 5 to 30 mm, more preferably from 6 to 25 mm. It is preferred, too, that the reinforcing fibers have a diameter of from 10 to 20, more preferably from 10 to 16 and most preferably from 10 to 13, e.g. 12 to 13 micrometers.

Preferably the fibers are used in a proportion of from 15 to 60% , more preferably from 20 to 40% by dry weight of the semi-finished product. At much below the 15 weight % level the quantity of fibers, e.g. glass fibers, is no longer sufficient to obtain advantageous final mechanical properties and at much above 60 weight %, moldability becomes insufficient for the transforming techniques which are usually applied to the semi-finished product.

By cylindrical fibers is meant, as opposed to fibrillated fibers, those fibers which, once spun, have a regular shape and smooth surface, and therefore which will not help to cause aqueous dispersion, or create mechanical binding, or powder retention.

With the process according to the invention, it is possible to produce a reinforced thermoplastics sheet in which each component is more or less perfectly dispersed and uniformly distributed through the thickness of the sheet, and in which the thermoplastics components and the reinforcement represent for example more than 96%, preferably from 97 to 99.5%, more preferably from 98 to 99.5% and optimally about 99%, of the dry weight of the semi-finished product.

By thermoplastics component is meant the polymer or mixture of polymers constituting the thermoplastics resin, as well as the additives which may be incorporated to facilitate hot-transformation of the semi-finished sheet and to provide desirable properties in the resulting final product (therefore present as such in the semi-finished sheet).

By reinforcement is meant the reinforcing fibers and possibly any optional non-fibrous reinforcing components such as mineral fillers.

Although the process according to the invention does not require the presence of a latex binder, it nevertheless is possible, by use of the process, to produce sheets of high powder content. In one preferred embodiment the sheets produced by the process of the invention have a ratio of powder to cylindrical fibers of from 1.5 to 5.7, and more preferably from 2 to 3, although such ratio is by no means a restriction on the process which permits production of sheets having a ratio of substantially any value; the ratio will be selected by the operator to meet the properties (flow moldability; strength etc.) required in the final product derived from the sheet.

The sheet according to the invention can also contain stainless steel fibers or aluminized glassfibers, in order to make the molded product conducting, and paper pulp cellulosic fibers to lower the cost of the composition, insofar as the molding requirements of the semi-finished product permit it and provided that this does not affect the properties necessary for the plastic application of the semi-finished sheet.

The thermoplastic resin used in the process of the invention is preferably a polyolefin such as polypropylene, polyethylene or copolymers, or a mixture of polyolefins; other thermoplastics polymers suitable for use in the process of the invention include polyamides, saturated polyesters, polystyrenes and their copolymers, polyphenylene ethers, polyvinyl chlorides, polycarbonates and other technical polymers or plastics alloys or mixtures of the above, known to those skilled in the art.

The thermoplastics resin is preferably used in powder form of average granulometry less than 800 micrometers and typically from 100 to 600 microns. Typical commercially available polymer powders will of course contain small proportions of particles with diameters above and below the average. At particle sizes much above 800 or 900 microns, the polymer powders can no longer be evenly distributed through the thickness of the sheet, especially if the density of the resin is, as for the polyolefins for example, less than 1 g/cm$^3$. In these circumstances it has been found that the particles tend to concentrate on the side of the sheet opposite to that through which the aqueous phase is drained.

Besides the above-mentioned fibers and polymer powders, the sheet produced according to the invention can also comprise, for technical or economical purposes:

other reinforcement, for example mineral fillers, glass microspheres or microballs, ground glassfibers or ceramics fibers, as thermoplastics components, a few percent of additives to improve adherence of the resin on the reinforcement when the piece is molded (post-lubricating of the type of organosilanes, organosilicones and others, titanates, polar polymers in dispersion), synthetic polyolefin pulps of high specific area, pigments or dyes, thermal stabilizers, and any other additives known by those skilled in the art to give to plastics materials an increased fluidity in the molten state, a resistance to light, to heat, and to other environmental stresses.

The above-described mixtures of reinforcing elements and thermoplastics components preferably represent 98 to 99.5%, e.g. about 99% of the thermoplastics sheet formed by the process of the invention, the remaining part being composed of residual traces of the different additives which are necessary for preparing by the wet method of the invention a sheet which will have the required qualities.

The problems arising when producing such a sheet with such a low additives content are therefore minimized through the successive steps of the process, embodiments of which are discussed hereinbelow.

(a) Dispersion of the reinforcing fibers in water can be performed without high dilution, that is at the normal concentrations conventionally used for cellulosic pulps in papermaking, i.e. 3% by weight and more of solid materials. The synthetic reinforcing fibers are used without the need for addition of a foaming agent or of a water viscosity modifying agent, yet in the presence of a preferably cationic dispersing agent, which preferably contains a fatty acid. The dispersing agent is preferably added to the medium in the proportion of from 5 to 15% by weight with respect to the weight of reinforcing fibers. In the case of post-lubricating, Si or Ti derivatives are preferably also added at this stage. According to one embodiment of the invention, the reinforcing fibers are continuously dispersed in step (a) and then mixed (as step (c)) in the required weight ratio with the dispersion of polymer powder from step (b).

(b) Dispersion, in parallel, of the powder elements. These are principally the thermoplastics components, i.e. the resin particles; however the dispersion may also contain non-fibrous reinforcing elements such as mineral fillers.

One advantage of the invention is that it is possible to confine the powders, even when these are very fine like certain additives, within the sheet in a homogeneous manner. Moreover, at least 98% weight of the final sheet can be comprised of the elements (resin powder and reinforcement) necessary for the final application. It has been found that this is possible owing to the ionic process which comprises first placing in suspension in water the resin and the other powdered materials, if necessary in the presence of an anti-foaming agent, then adding a few parts per thousand by weight, with respect to the powders, of an anionic material, e.g. a polycarboxylic polymer, so as to give a negative charge to the particles. After being mixed with the cationic fibrous dispersion from step (a), the charged particles consequently interact with the surface of the reinforcing fibers. In step (b) it is preferred to use anionic polycarboxylic polymers which are sufficiently hydrophobic to have an affinity towards the resin particles and sufficiently anionic to allow anionic interaction. Examples of such polymers are those containing acrylic units, such as copolymers of an acrylic acid with ethylene; or partly hydrolized polyacrylamides. With such polymers, the degree of ionicity, i.e. the carboxylic groups content, is such that the properties of said polymers in water are largely dependent on the pH. Preferably, between 0.1 and 0.5% of such an anionic polycarboxylic polymer is thus introduced, with respect to the weight of powdered material. The person of ordinary skill in the art will readily be able to determine the suitability of any particular ionic polymer additive for use in step (b), by simple tests of ionic potential or by trial and error. Various additives of this nature are commercially available, and some of those which may be employed are mentioned hereinafter in the specific Examples. Such additives typically have molecular weights in the range 1-6 million.

(c) The mixing of the two dispersions of respectively fibers and powders of opposite polarity may be carried out by any of the known mixing techniques. At this stage it is also preferred to introduce the optional polar polymers which serve to improve certain properties of the final product, dependent on the adherence of the resin to the reinforcement.

(d) In step (d), the mixed dispersions are subjected to partial flocculation. This is achieved by addition of a flocculating agent of charge opposite to that of the mixture. Such agent may be for example a cationic organic polyelectrolyte of high molecular weight (for example a cationic polyacrylamide such as a copolymer of acrylamide and a quaternary cationic monomer). The proportion of flocculating agent is preferably from 0.5 to 1.5% by dry weight of aqueous suspension. The molecular weight of the agent is preferably from 500,000 to 2 or 3 million, preferably about 1,000,000.

(e) Step (e) comprises draining the suspension and drying the semi-finished product. Draining may be carried out in typical paper making fashion by carrying the flocculated suspension on a metallic mesh or wire. Other draining techniques may equally be used. The resulting wet sheet substantially only contains (in addition to water) those elements (polymer powder and reinforcement) required for the final plastic product application, which elements are uniformly distributed throughout the thickness of the sheet and in the initially introduced proportions. After draining, the sheet is in one embodiment transferred to a supporting machine wire belt where it is dried. Preferably it is then brought, at least on its surface, to a temperature at least equal to the resin melting temperature (or in the case of a mixture, to the melting temperature of the lowest melting plastics component), so that at least on the surface of the sheet, the thermoplastics elements melt. Thus on cooling, they bond the reinforcing fibers together. The sheet then has sufficient cohesion not to require a support and it can withstand any manipulations necessary for its storage or transformation.

The dryness of the sheet discharged from the draining stage, e.g. cylinder mold or Fourdrinier machine, depends, among other things, on the granulometry of the powders used. In order to obtain a rapid and efficient drying, depending on the drying method used (infrared-radiation, high frequency radiations, hot air, belt presses or flat presses or any combination of different means), it may be advisable to conduct a wet pressing of the sheet so that densities and dryness reach a maximum. However in the case of drying by penetrating hot air, wet pressing is not generally compatible with this kind of drying as it would reduce the porosity of the sheet.

Optionally, additives can be introduced after forming the sheet, by impregnation, spraying, powdering or any equivalent means.

DETAILED DESCRIPTION OF THE INVENTION

The invention will be more readily understood on reading the following examples, in which continuous sheets have been produced according to the invention on a Fourdrinier table. After formation and without any wet pressing, the sheet was dried in a tunnel where it was supported by a wire web: a light suction of 30 to 300 mm of water column was applied under the machine wire web to allow the passage from top to bottom through the sheet of a stream of air heated to a temperature at least equal to the melting point of the resin.

The semi-finished sheets formed by the process of the invention were eventually transformed into molded products according to the following pressing cycle: preheating at 240° C. between heating plates under a pressure of three bars, then transfer of the hot material into a mold heated to 80° C. where it was pressed under 130 bars into a circular laboratory piece of weight 230 g and diameter 22 cm, from which were cut the test pieces necessary to test the plastic properties. All the quantities quoted in the following are in parts by dry weight; the concentrations are in grams of dry material per liter; and the mechanical properties were measured at 23° C., and at 50% relative humidity.

EXAMPLE 1

In the presence of 1 part of cationic dispersing agent containing fatty acids supplied by SANDOZ under the name CARTASPERS® DS1, 8 parts of glassfibers in the form of glass strands cut in lengths of 6.5 mm (reference R18DX9 supplied by OWENS CORNING FIBER GLAS EUROPE) are dispersed at a concentration of 40 g per liter, then 52 parts, previously dispersed in water, of a polypropylene homopolymer powder known as PROPATHENE® (Reference GX 543M supplied by ICI), are added, 70% of the particles of which have a diameter between 210 and 350 micrometers.

In parallel, a layer of a mat of glassfibers UNIFILO® (supplied by VETROTEX-SAINT GOBAIN), of surface density 225 g per square meter, is laid on the surface of a laboratory hand form.

After dilution at 2 g per liter, the mixture of cut fibers and powder is introduced under stirring of compressed air, over the mat, then it is drained through it, so as to produce a sample sheet of 560 g per square meter, constituted for 40 parts of UNIFILO® mat. This wet sample is self-supporting, but the cut fibers and the powder are essentially situated on the side of the mat opposite the wire web. After drying in an oven at 210° C. followed by transformation, a piece is obtained of which one face has a very fibrous appearance due to the presence of the mat and in which the glass content varies, according to the sampling location, between 35 and 60% by weight.

This example confirms the advantage of having a matless homogeneous semi-finished product.

EXAMPLE 2

60 parts of homopolymer polypropylene powder SHELL® (Reference RY6100 supplied by SHELL CHIMIE) with an average particle diameter of 106 micrometers, and 40 parts of glass strands R18DX9 cut in lengths of 6.5 mm, are dispersed at a final concentration of 35 g per liter, in the presence of 4 parts of CARTASPERS® DS1.

At the head of the machine, are added in continuous manner, 0.75 part of carbon black powder and 0.5 part of an acrylamide copolymer and of a quaternary cationic monomer, of high molecular weight (SEPAR- AN® XD 8494 supplied by DOW CHEMICAL FRANCE).

The suspension is admitted on a Fourdrinier table, the wire web of which has an aperture size of 214×317 micrometers, therefore greater than the size of the particles of resin.

The sheet discharged from the machine has a dryness of 55%: under a stream of air at 160° C., going through it under the effect of a depression of 130 mm of water column, it is dried until melting of the resin. Once slightly cooled, the sheet becomes self-supporting and can withstand all the necessary manipulations.

The glass fibers are all individualized but particles retention is poor, so that after molding, the product is only slightly colored and has a glass content of 52%.

This example illustrates the necessity of using a technical means to prevent the non-fibrous elements from being lost through the wire cloth.

EXAMPLE 3

In the same conditions as in Example 2, the mixture of glassfibers is prepared this time with the powder PROPATHENE® GX543M: the wire cloth of the papermaking machine is then going to act as a sieve. 1.2 parts of a powder of an antioxidant are also added ( a thioether with phenolic groups).

Due to the fact that the granulometry of the resin is higher than in Example 2, the sheet discharged from the machine has a dryness of 62%, and it is then dried, and thermo-strengthened at 160° C. under a depression of 100 mm of water column.

The polypropylene powder is retained but it is not evenly distributed inside the sheet and it is found that the mechanical properties after molding do not reach the target level for a glass content of 40%.

modulus in flexure: 3800 MPa.
Breaking bending stress: 95 MPa.
Breaking tensile stress: 55 MPa.

The product also has a very low thermal stability.

This example proves the advantage of proposing a physico-chemical process in order to obtain a homogeneous material with all the necessary thermoplastics components.

EXAMPLE 4

This time the invention is applied.

Still in the presence of 4 parts of CARTASPERS® DS1, 40 parts of the same fibers R18DX9, as in the preceding examples, in lengths of 6.5 mm, are dispersed at the concentration of 40 g per liter.

In parallel, 60 parts of SHELL® RY6100 powder, 1 part of the antioxidant of Example 3 and 0.5 parts of carbon black are dispersed in another chest at the concentration of 50 g per liter in the presence of 0.18 part of an anti-foaming agent (FOAMASTER® VL supplied by DIAMOND SHAMROCK); after five minutes, 0.18 part of a strongly anionic carboxylated polyacrylamide, of molecular weight 4–6 millions (SEPARAN® AP273 supplied by DOW CHEMICAL FRANCE) is added, and then the suspension of powders is introduced into the dispersion of glassfibers; the resulting mixture is partly flocculated.

Flocculation is completed at the head of the machine by adding 0.75 part of SEPARAN® XD 8494 and the suspension is admitted on the same machine table as in Examples 2 and 3.

The sheet discharged from the machine has a dryness of 53% and the depression inside the tunnel is 140 mm of water column.

Contrary to Example 2, retention of the powders is very good, the losses through the wire cloth being, over several tests, less than 0.5% and sometimes 0.25%; moreover, the powders are uniformly distributed through the thickness of the sheet, so that the molded pieces are very black, have a good thermal stability and present the following mechanical properties:

modulus of flexure: 5150 MPa.
Breaking bending stress: 110 MPa.
Breaking tensile stress: 65 MPa.

EXAMPLE 5

Example 4 is reproduced by replacing the SHELL® RY6100 powder with the coarser powder PROPATHENE® GX543M.

Contrary to Example 3, the polypropylene powder is adequately distributed so that the mechanical properties of the molded product are the same as in Example 4.

EXAMPLE 6

Example 4 is repeated using instead of the R18DX9 fibers, glassfibers of another origin, of same length-/diameter ratio but cut in lengths of 6 mm (reference EC10. 160 5093X5 supplied by VETROTEX-SAINT GOBAIN). Losses through wire cloth are 0.2%.

This assembly shows that the process is not linked to a given quality of glassfibers and the molded product also shows the required properties, among which a modulus of flexure of 5050 MPa.

EXAMPLE 7

This confirms Example 6 in that, this time, a third quality of glassfibers is used; the BT 78 GX2 cut in lengths of 6.5 mm (supplied by OWENS CORNING FIBERGLASS EUROPE). The following measurements are taken on the molded piece having a glass content of 41%:

modulus of flexure: 5900 MPa.
Breaking bending stress: 113 MPa.
Breaking tensile stress: 67 MPa.

EXAMPLE 8

Still using the principle of Example 4, 26 parts of glassfibers are dispersed in the presence of 2.6 parts of CARTASPERS® DS1, then to the resulting dispersion are added 74 parts of SHELL® RY6100 powder prepared with 0.22 part of FOAMASTER® VL and 0.22 of SEPARAN® AP 273, with one part of antioxidant and 0.5 part of carbon black.

The mixture is flocculated by 0.80 part of SEPARAN® XD 8494 and the suspension is admitted on a wire cloth. The following table reports the values of the Zeta potential (method according to the streaming potential) at various stages, and the retention for two types of glass-fibers:

| Glass | R18DX9 6.5 mm | 5093X5 6 mm |
|---|---|---|
| Zeta dispersion in mV | +50 | +54 |
| Zeta mixture in mV | −124 | −144 |
| Zeta suspension in mV | +126 | +158 |
| Losses under wire cloth % | 0.6 | 0.3 |

This example therefore illustrates the ionic effect of the manufacturing additives used and also shows that it is possible to obtain a homogeneous sheet, virtually free of said additives, but nonetheless with a high powder/-cylindrical fibers ratio.

The mechanical characteristics are (fibers R18DX9):
modulus of flexure: 3600 MPa.
Breaking bending stress: 90 MPa.
Breaking tensile stress: 55 MPa.

EXAMPLE 9

Example 8 is reproduced (Fibers 5093X5) by taking another cationic polyacrylamide of high molecular weight, called SEPARAN® CP402 (supplied by DOW CHEMICAL FRANCE): the required sheet is obtained with, for 0.75 part, a retention of 99.6%. The performance of the process is not, therefore, tied to any special cationic polyacrylamide.

EXAMPLE 10

Example 8 is repeated (fibers R18DX9) except that the quantity of anionic caboxylated polyacrylamide has varied, the quantity of cationic polyacrylamide being adjusted accordingly.

| Preparation | 10-1 | 10-2 | 10-3 | 10-4 |
|---|---|---|---|---|
| SEPARAN® AP 273 in parts | 0 | 0.074 | 0.37 | 0.37 |
| Cationic polyacrylamide in parts | explored field 0 to 1.25 | 0.30 | 1.20 | 0.30 |
| Losses under wire cloth % | 20 and + | 0.5 | 0.1 | 18 |

This example illustrates the advantage of the process and the quantities of additives that should be used: each time technician will adjust the proportions of anionic polycarboxylic polymer and of cationic polyacrylamide as a function of his manufacturing equipment (and in particular shearing stress and turbulences) so as to reach the best comprise of machine speed/retention/sheet quality.

In the present case, the preparation 10-3 affords a greater hourly output, but with a lesser quality of formation than preparation 10-2.

EXAMPLE 11

It is hereagain proceeded as for Example 8 (Fibers 5093X5) except that the nature of the anionic polycarboxylic polymer is changed by using instead of the SEPARAN® AP 273, 0.22 part of:

Preparation 11-1: slightly anionic polyacrylamide of molecular weight 1-3 millions (SEPARAN® NP10 supplied by DOW CHEMICAL FRANCE)

Preparation 11-2: strongly anionic polyacrylamide of molecular weight 1-3 millions (SEPARAN® AP30 supplied by DOW CHEMICAL FRANCE)

Whatever the quantity of cationic polyacrylamide used (0 to 1.25 parts by weight), it is impossible to form a sheet with preparation 11-1. On the contrary, the target sheet is obtained with preparation 11-2 after addition of 0.75 part of cationic polyacrylamide (losses under wire cloth: 0.8%).

This example illustrates that the polycarboxylic polymer must have a very pronounced anionic nature.

EXAMPLE 12

Still according to Example 8 (Fibers 5093X5), but this time acting on the anti-foaming agent.

| Preparation | 12-1 | 12-2 |
|---|---|---|
| Antifoaming agent | no agent | NOPCO® 8034 (supplied by DIAMOND SHAMROCK) 0.22 part |

In the two cases, the required sheet is obtained, with a retention at least equal to 99.2%, for 0.75 part of cationic polyacrylamide.

This example shows that the anti-foaming agent is only an optional additive in the process.

EXAMPLE 13

The same quantities as in Example 8 are used except that the glass fibers (R18DX9) are dispersed in continuous manner and are mixed with the dispersion of powders, using a metering pump. A homogeneous sheet is hereagain obtained with losses under wire cloth of 0.4% for 0.63 part of cationic polyacrylamide.

EXAMPLE 14

The same principle is used as in Example 4, except that this time 31 parts of glassfibers (R18DX9) are used in the presence of 3.1 parts of CARTASPERS® DS1 and of 4 parts of cellulosic (fibers bleached softwood pulp). Then this dispersion is mixed with 65 parts of a polypropylene powder prepared in parallel with 0.19 part of the anti-foaming agent and of the anionic carboxylated polyacrylamide, as well as the plastics additives of Example 4. After addition of 0.75 part of cationic polyacrylamide, the sheet is obtained still on the same equipment.

| Preparation | 14-1 | 14-2 |
|---|---|---|
| Mean diameter of the polypropylene powder in micrometers | 106 (SHELL® RY 6100) | 570 (ELTEX® P HVOO1P supplied by SOLVAY) |
| Modulus of flexure | 4800 | 4600 |
| Breaking bending stress | 110 | 106 |
| Tensile bending stress in MPa | 66 | 63 |

With powders of very different granulometry, the process permits the manufacture of very comparable materials, for example with cellulosic fibers.

EXAMPLE 15

Example 14 is repeated, except that the polyproylene powder is replaced with another resin, a powdered form of a modified oxide polyphenylene (NORYL® supplied by GENERAL ELECTRIC). The mechanical properties are:

modulus of flexure: 6300 MPa.
Breaking bending stress: 135 MPa.
Breaking tensile stress: 75 MPa.

EXAMPLE 16

This differs from Example 14 in that only 60 parts of polypropylene powder SHELL® RY 6100 (with 0.18 part of anti-foaming agent and of anionic polyacrylamide, as in Example 4) are dispersed, and in that after mixing with the dispersion of reinforcing fibers, 5 parts of an aqueous dispersion of a polar polymer are added in order to improve the mechanical properties after molding, (comparatively to Example 14).

| Preparation | 16-1 | 16-2 |
|---|---|---|
| Polar polymer | Polyvinyl acetate (RHODOPAS ® supplied by RHONE-POULENC) | modified polyolefin (EPOLENE ® supplied by EASTMAN CHEMICAL PRODUCTS) |

Modulus of flexure: 5100 MPa.
Breaking bending stress: 118 MPa.
Breaking tensile stress: 70 MPa.

EXAMPLE 17

8 parts of cellulosic fibers and 26 parts of a glass wool (mean length of the fibers: 17 mm, mean diameter: 5.7 micrometers—EVANITE ® supplied by EVANS PRODUCTS COMPANY) are dispersed in the presence of 2.6 parts of CARTASPERS ® DS1, and 6 parts of a polyethylene synthetic pulp (PULPEX ® EA supplied by HERCULES) are added. The resulting dispersion is then mixed with a dispersion of 60 parts of polypropylene powder (PROPATHENE ® prepared as in Example 4. After addition of 0.75 part of a cationic polyacrylamide, the target sheet-form material is obtained.

What is claimed is:

1. A process for preparing by the wet method a reinforced thermoplastics semi-finished product in sheet form, which process comprises the following steps:

(a) mixing
  (i) a first aqueous dispersion of an ionic dispersing agent having an ionic charge with reinforcing fibers, and
  (ii) a second aqueous dispersion containing at least one thermoplastics polymer powder and at least one ionic polymer additive of opposite charge to that of the ionic dispersing agent of the first dispersion, to form a mixture, (b) incorporating into the mixture a flocculating agent in ionic polymer form, of high molecular weight and of charge opposite to that of said mixture, and (c) draining the resulting suspension and drying the resulting semi-finished product.

2. A process according to claim 1, wherein the thermoplastics components and the reinforcements constituted of the fibers and optional fillers represent from 98 to 99.5% of the total dry weight of the semi-finished product.

3. A process according to claim 1 wherein the powder is a polyolefin resin.

4. A process according to claim 1 wherein the reinforcing fibers comprise cylindrical fibers, the powder/cylindrical fibers ratio being between 1.5 and 5.7 , and preferably between 2 and 3.

5. A process according to claim 1 wherein the reinforcing fibers comprise glassfibers.

6. A process according to claim 1 wherein the reinforcing fibers comprise from 15 to 60% and preferably 20 to 40% by dry weight of the semi-finished product.

7. A process according to claim 1 wherein the length of the reinforcing fibers is from 5 to 30 mm, and preferably from 6 to 25 mm.

8. A process according to claim 1 wherein the reinforcing fibers have a unit diameter in the range of 10–20 microns.

9. A process according to claim 1 wherein the means granulometry of the powder is less than 800 microns.

10. A process according to claim 1 wherein the dispersing agent is used in the proportion of from 5 to 15% with respect to the weight of the reinforcing fibers.

11. A process according to claim 1 wherein the first dispersion further includes cellulosic fibers and/or polyolefin pulp.

12. A process according to claim 1 wherein the second dispersion further includes one or more additives selected from dyes, thermal stabilizers, antistatic agents and age-protecting agents.

13. A process according to claim 1 wherein the second dispersion comprises from 0.1 to 0.5% of the ionic polymer additive with respect to the dry weight of powdered material contained therein.

14. A process according to claim 1 wherein the ionic polymer additive component of said second dispersion comprises an anionic polycarboxylic polymer.

15. A process according to claim 1 wherein the ionic polymer flocculating agent is incorporated into the mixture in the proportion of from 0.5 to 1.5% with respect to the dry weight content of the aqueous suspension.

16. A process according to claim 1 wherein the ionic polymer flocculating agent comprises a cationic polyacrylamide.

17. A process according to claim 1 wherein simultaneously with or subsequent to the drying stage, at least the surface region of the semi-finished product is brought to a temperature at least equal to the softening temperature of the thermoplastic polymer(s) so as to at least partially melt and coalesce said polymer thereby bonding the reinforcing fibers within the semifinished product.

18. A semi-finished reinforced thermoplastics product in sheet form, comprising from 96 to 99.5% by weight of well dispersed and uniformly distributed thermoplastics component, reinforcing fibers and optionally reinforcing filler(s), the balance including the residues of dispersing agents, ionic polymer additives and flocculating agents derived from the process by which said product is formed.

19. A moulded article comprising a semi-finished product according to claim 18 which has been subjected to a shaping operation under applied pressure and at a temperature sufficient to melt the thermoplastics component of said semi-finished product.

20. A moulded article comprising a semi-finished product produced by the process according to claim 1, which has been subjected to a shaping operation under applied pressure and at a temperature sufficient to melt the thermoplastics component of said semi-finished product.

21. A process for preparing by the wet method a reinforced thermoplastics semi-finished product in sheet form, which process comprises the following steps:

(a) mixing
  (i) a first aqueous dispersion of from 5 to 15 wt % based on the fibers of a cationic, fatty acid-containing dispersing agent with reinforcing glass fibers of length from 6 to 25 mm and unit diameter from 10 to 20 microns, and
  (ii) a second aqueous dispersion containing at least one thermoplastics polymer powder of average granulometry less than 800 microns and from 0.1 to 0.5 wt % based on the dry powder weight of at least one ionic polycarboxylic polymer additive of opposite charge to that of the first dispersion, to form a mixture, (b) incorporating into the mixture from 0.5 to 1.5 wt % based on the dry weight of the aqueous suspension of a cationic polyacrylamide flocculating agent, of high molecular weight and of charge opposite to that of said mixture, and (c) draining the resulting suspension and drying the resulting semi-finished product.

22. A process according to claim 14 wherein the anionic polycarboxylic polymer is an ethylene/acrylic acid copolymer or a partially hydrolysed polyacrylamide.

23. A process according to claim 1 wherein simultaneously with or subsequent to the drying stage, at least the surface region of the semi-finished product is brought to a temperature at least equal to the lowest melting temperature of the thermoplastic polymer(s) so as to at least partially melt and coalesce said polymer thereby bonding the reinforcing fibers within the semi-finished product.

24. A semi-finished reinforced thermoplastics product according to claim 18 wherien the product does not comprise latex binders.

25. A process for preparing by the wet method a reinforced thermoplastics semi-finished product in sheet form, which process comprises the following steps:

(a) mixing (i) a first aqueous dispersion of a cationic dispersing agent with reinforcing fibers, and (ii) a second aqueous dispersion containing at least one thermoplastics polymer powder and at least one ionic polymer additive of opposite charge to that of the first dispersion, to form a mixture, (b) incorporating into the mixture from 0.5 to 1.5 wt % based on the dry weight of the aqueous suspension of a cationic polyacrylamide flocculating agent, of high molecular weight and of charge opposite to that of said mixture, and (c) draining the resulting suspension and drying the resulting semi-finished product.

26. A process according to claim 25, wherein the cationic dispersing agent comprises one or more fatty acids.

* * * * *